United States Patent [19]

Isaac

[11] 4,378,942

[45] Apr. 5, 1983

[54] TRADING GAME

[76] Inventor: Paul J. Isaac, P.O. Box 456, Tuckahoe, N.Y. 10707

[21] Appl. No.: 218,178

[22] Filed: Dec. 19, 1980

[51] Int. Cl.[3] ..... A63F 3/00; A63F 1/00

[52] U.S. Cl. ..... 273/278; 273/297; 273/240

[58] Field of Search ..... 273/256, 278, 277, 251, 273/297

[56] References Cited

U.S. PATENT DOCUMENTS

| | | | |
|---|---|---|---|
| 168,570 | 10/1875 | Lamb | 273/278 |
| 1,460,966 | 7/1923 | Johnson | 273/297 |
| 1,553,736 | 9/1925 | Wyle | 273/297 |
| 1,760,287 | 5/1930 | Schippers | 273/278 |
| 2,484,051 | 10/1949 | Robbins, Jr. | 273/256 |
| 3,539,189 | 11/1970 | Shelton | 273/256 |
| 4,040,629 | 8/1977 | Kelly | 273/278 |

*Primary Examiner*—Richard C. Pinkham
*Assistant Examiner*—Scott L. Brown
*Attorney, Agent, or Firm*—Kenyon & Kenyon

[57] ABSTRACT

The trading game simulates a highly liquid market. The game employs tokens and various "Bull" and "Bear" cards to establish a settlement price for various trades. The players create the market prices for each trade during the rounds of play and record the transaction prices on tally sheets. At the completion of a game/-round the transaction prices are compared with the determined settlement price to obtain the profit or loss.

10 Claims, 3 Drawing Figures

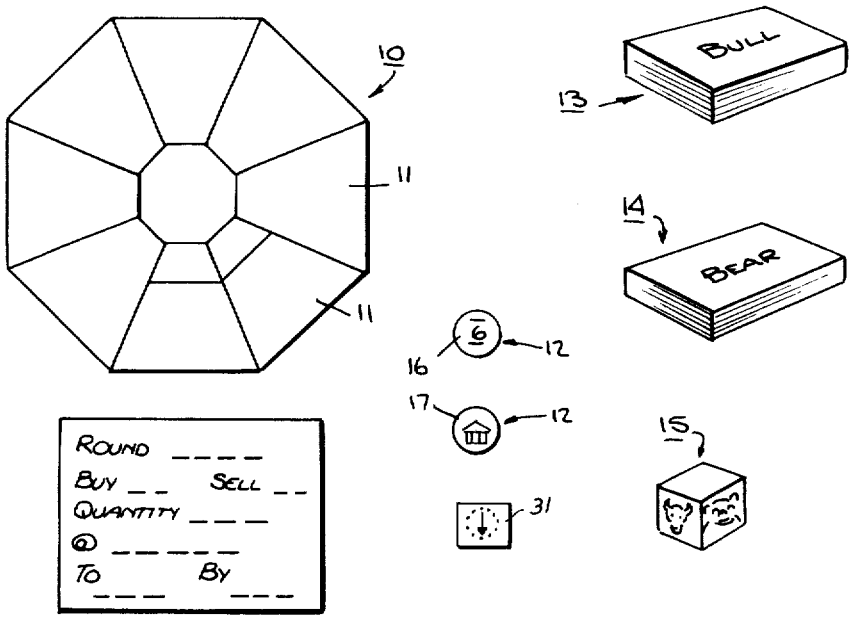

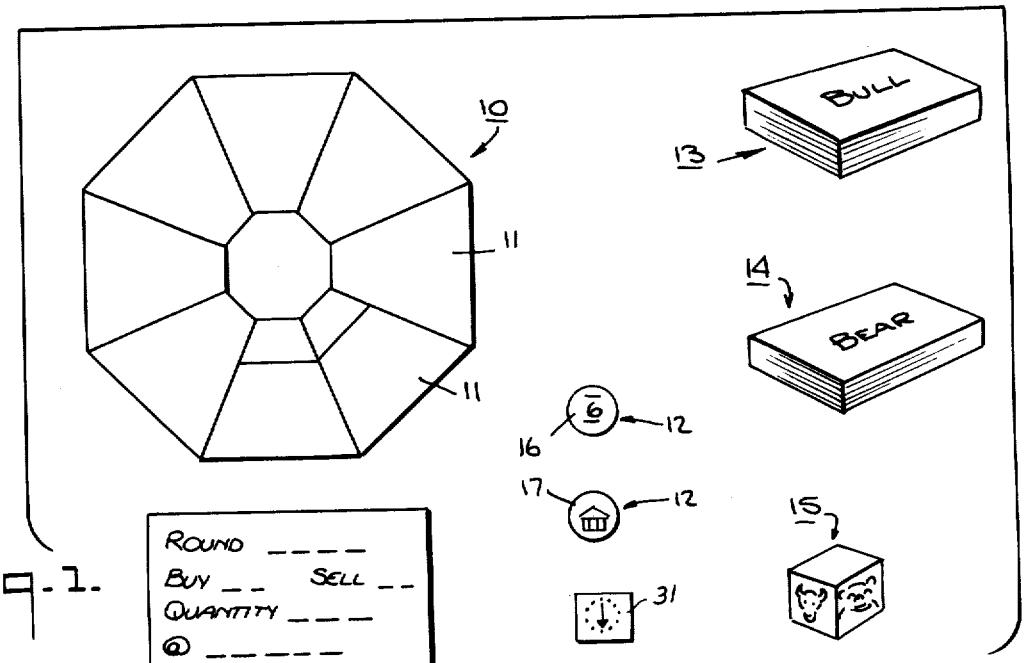

Fig. 1.

TRADERS TALLY SHEET

| ROUND | OTHER SIDE | BUY/SELL | SALE PRICE | - SETTLEMENT = | | PURCHASE SETTLEMENT | - PRICE = | | PROFIT OR LOSS ON TRADE × QUANTITY | = TRADE LOSS | TRADE PROFIT |
|---|---|---|---|---|---|---|---|---|---|---|---|
| 1 | C | S | 56 | -58 | =-2 | 58 | | | × 1 | = -2 | |
| | H | B | | - | = | 58 | -52 | =+6 | × 1 | = | +6 |
| | F | B | | - | = | | -52 | =+6 | × 1 | = | +6 |
| | F | S | 65 | -58 | =+7 | | - | = | × 1 | = | +7 |
| | H | S | 63 | -58 | =+5 | | - | = | × 1 | = | +5 |
| | C | S | 63 | -58 | =+5 | | - | = | × 1 | = | +5 |
| | D | B | | - | = | 58 | -59 | =-1 | × 1 | = -1 | |
| | B | B | | - | = | 58 | -53 | =+5 | × 1 | = | +5 |
| | G | B | | - | = | 58 | -52 | =+6 | × 1 | = | +6 |
| | B | S | 50 | -58 | =-8 | | | | × 1 | = -8 | |
| | | | | | | | | | | -11 | +40 |
| | | | | | | | | | | 40-11 = +29 | |
| 2 | | | | | | | | | | | |

Fig. 2.

BROKERS TALLY SHEET

| PLAYER | ROUND 1 PROFIT | ROUND 1 LOSS | ROUND 2 PROFIT | ROUND 2 LOSS | ROUND 3 PROFIT | ROUND 3 LOSS | ROUND 4 PROFIT | ROUND 4 LOSS |
|---|---|---|---|---|---|---|---|---|
| A | +29 | | | | | | | |
| B | + 5 | | | | | | | |
| C | +22 | | | | | | | |
| D | | -16 | | | | | | |
| E | | - 8 | | | | | | |
| F | | -18 | | | | | | |
| G | +21 | | | | | | | |
| H | | -35 | | | | | | |
| | +77 | -77 | | | | | | |

Fig. 3.

TRADING GAME

This invention relates to a trading game. More particularly, this invention relates to a market trading game.

As is known, various types of games have been devised for enjoyment purposes. In some cases, the games are based upon a simple task of moving a token from one point to another over a path defined by a sequence of blocks. Generally, movement is controlled by chance by rolling one die or more than one die, by picking cards with numerical indicia thereon, by using spinners, and the like. In other cases, games have been devised to be more sophisticated by introducing additional variables into the game, for example by introducing rewards or penalties for arriving in certain places or by being replaced by another player's token when arriving at a given block. Still other games have been devised to obtain certain goals, such as an accumulation of value cards, property cards, and the like. The sophistication of these games has also been increased by introducing trading situations so as to pit one player's trading acumen against another's. In this latter respect, various types of games have been devised to attempt a simulation of a stock market, such as described in U.S. Pat. Nos. 3,559,993; 3,770,277 and 3,980,307. However, in such cases, the games have been predicated upon externally established transaction prices for the various stocks to be traded and, as a result, the volatility, competition and/or sophistication of an actual market have not been simulated.

Accordingly, it is an object of the invention to provide a trading game which simulates a financial market.

It is another object of the invention to provide a stock trading game wherein the prices at which trades are consummated can be established between trading partners.

It is another object of the invention to provide a market trading game of heightened interest.

It is another object of the invention to provide a market trading game which can be played at various interest and ability levels.

Briefly, the invention provides a trading game which simulates a financial market, such as a stock market, commodities market, government bond market and the like. The mechanics of the game are applicable to any inter-active, competitive trading financial market.

The game is played in a series of rounds, each of which includes a number of trading sessions of timed duration. Each session of a round deals with the trading, i.e. the buying and selling, of one or more "contracts" representative of a stock, commodity or bond. During trading, a clearing broker first establishes a market for the contract and play progresses among the players to trade within that market or to change the market from time-to-time within certain limits. At the completion of a round, a settlement price is established for the "contract" and all transactions are measured against that settlement price to determine the profits and losses made by each player.

The game comprises randomly selected means for establishing a settlement price for a given round of play, a plurality of transaction tickets, a plurality of trader's tally sheets and at least one broker's tally sheet.

The means for establishing a settlement price includes a plurality of tokens, each of which has a numbered indicia on one side selected from a given numerical range; a first set of "Bull" designated cards, each of which has an indicia of an event on one side and an indicia of a numerical weight for the event in order to establish a component of the settlement price; a second set of "Bear" designated cards, each of which has an indicia of an event on one side and an indicia of a numerical weight for the event in order to establish another component of the settlement price; and a die with an indicia of a "Bull" or a "Bear" on each of a selected number of faces for selecting a card from one or the other set of cards during play.

In order to establish the settlement price, each player chooses one or two tokens at the beginning of a round. In addition, during play, one or two cards are selected from the "Bull" and/or "Bear" sets. Upon completion of a round, the values indicated on the selected tokens and the values indicated by the "Bull" and/or "Bear" cards are totalled to establish the settlement price.

Each transition ticket has indicia for recording a round number, for recording whether a "buy" or "Sale" transaction was made, a quantity of the transaction, i.e. the number of shares bought or sold, a price for the transaction, and the names of a purchaser and a seller. Each transaction ticket may be used for only one round or may be provided with indicia for more than one round.

Each trader's tally sheet has indicia for determining a profit or a loss for each transaction of a player in a given round relative to the settlement price. For example, the tally sheet includes separate columns for subtracting the established settlement price friom the actual sales price to determine a profit or loss for a given sales transaction as well as a separate column for subtracting the price of the actual purchase price from the settlement price to establish a profit or loss for a given purchase transaction.

The broker's tally sheet has indicia for itemizing and totaling the profits and losses of all players in a given round. This serves to establish a check on the various computations made by the players on the individual tally sheets.

The trading game may also include a timer for establishing a timed duration for a given round of play.

The object of the trading game is to consummate as many profitable trades as possible. Thus, the amount of profit during a game, and not the number of trades, determines the winner.

In starting the game, a drawing of tokens is made to determine the clearing broker. Thereafter, each player draws one token and play begins. At this time, the clearing broker "makes a market" that is, the clearing broker offers to buy or sell at least one contract at prices not more than, for example three points apart such as "48-51". This means that the broker will buy at 48 and sell at 51. Thereafter, any other player can "lift his offering", i.e. buy at 51, or "hit his bid", i.e. sell at 48. As long as the market remains valid, any other player may offer to buy at 51 or to sell at 48. Further, an offer may be made to buy more than one contract at a given price. The initiating player may, however, indicate that the number of contracts which can be traded is limited. The initial market remains firm with subsequent players either hitting the initial bid or lifting the initial offering until different bids or offerings are made by the subsequent market makers or until trading occurs.

When a trade occurs, transaction tickets are exchanged between the buyer and the seller. The round is numbered on each ticket so that tickets from various rounds are not confused. The "Buy" or "Sell" is circled depending upon what the player is doing, the price and volume are recorded and the respective buyer's and seller's position or initials are indicated. The tickets are then exchanged between the two traders.

If no trades occur on the opening quote of the clearing broker, play proceeds to the next player with the requirement that each subsequent player must either narrow the market by at least one point or hit the best firm bid or take the best firm offer for at least one contract. Any player at any time may interject his market so long as his bid is higher or his offering is lower than the previous market. If a market is interjected, the market narrowing process begins anew with the next adjacent player.

The element of chance news in the game is introduced via the Bull and Bear cards. The Bull cards tend to be news that would increase the settlement price whereas the Bear cards are predominantly news cards that would usually reduce the settlement price. Before the game starts a number of Bull and Bear cards are dealt out of each set of cards and placed aside. These cards are selected by a roll of the die at the end of certain sessions of a round, for example the first and third sessions of a four session game. An additional token may also be selected, for example at the end of the second session of the round.

At the completion of the game, all players display their tokens and the Bull and/or Bear cards are turned over. The settlement price is then calculated as a sum of all the values on the tokens plus or minus the values on the two Bull/Bear cards for the round. This settlement price is the final value of the contract and is the bench mark against which all trades are measured during the round for profit or loss.

Each player then calculates his profit or loss by adding the differences between his transaction prices and the settlement price when he bought contracts at a lower price or sold contracts at a higher price than the settlement price, and by subtracting the differences between the settlement price where he either bought contracts at a higher price or sold them at a lower price than the settlement. These values are recorded on the trader's tally sheet. Thereafter, each player calculates his gain or loss and reports the gain or loss to the clearing broker for entry on the broker's tally sheet. The broker then adds up the gains for all the players who had gains and adds up all the losses for the players who had losses. The total of the gains must always equal the total of the losses. If there is an error, each player then checks his own tally sheet to determine where an error has been made.

The game may be played with variations. For example, certain players may be designated as unsophisticated speculators who are automatically assumed to have drawn a total of 9 as their disks for a given round for purposes of fixing the settlement price. Alternatively, the players may be grouped into three different classes of market knowledge. One group may be the unsophisticated speculators having automatic 9's for the purposes of fixing settlement; the second group will be semi-sophisticated and may be shown the Bull and Bear cards which are drawn during a game so as to have some market information but not as much as a regular player; the third group will draw the same number of tokens and therefore have the same knowledge of the ultimate settlement price as a regular player.

These and other objects and advantages of the invention will become more apparent from the following detailed description taken in conjunction with the accompanying drawings wherein:

FIG. 1 illustrates various elements used in the stock trading game;

FIG. 2 illustrates a fragmentary view of a trader's tally sheet; and

FIG. 3 illustrates a view of a broker's tally sheet.

Referring to FIG. 1, the trading game, such as a stock trading game, may be played on a board 10, for example of octogonal shape, which contains a plurality of player-designated sections 11.

The game includes a randomly selected means for establishing a settlement price for a given round of play of multiple buy/sell transactions. This means includes a plurality of tokens 12, two sets of cards 13, 14 and a die 15. Each token 12 is in the form of a plastic disk and has numbered indicia on one side 16 selected from a given numerical range, for example 0 to 9, for establishing the settlement price while the obverse side 17 is provided with a fanciful mark. For example, there are ten of each disk numbered 0 through 9. These disks 12 can be retained in a small cloth drawstring bag or other suitable container.

One set of cards 13 is designated "Bull" cards while the other set 14 is designated "Bear" cards with each set containing twenty-four cards. Each card has an indicia of an event on one side and an indicia of a numerical weight for the event in order to establish a component of the settlement price. For example, the Bull cards represent the following:

| BULL CARDS | | VALUE |
|---|---|---|
| (1) | Production forecast raised by government agency | 0 |
| (2) | GNP (i.e. Gross National Product) rises more than expected | +1 |
| (3) | GNP change for this quarter meets expectations but last quarter revised up | −1 |
| (4) | Popular bearish economist turns around | +1 |
| (5) | Chart support level pierced, technicians buy | +2 |
| (6) | Major overseas strike and shipments stopped | −1 |
| (7) | Producing nations start price support program | 0 |
| (8) | Sharp drop in warehouse inventories | +2 |
| (9) | Retail sales up | −2 |
| (10) | Unemployment up | 0 |
| (11) | Value of dollar drops against other currencies | +1 |
| (12) | Producers raise prices | 0 |
| (13) | Congress votes purchases for strategic stockpile | 0 |
| (14) | Auto sales up | +2 |
| (15) | Durable goods orders up | +1 |
| (16) | Personal income up | +1 |
| (17) | Precious metals rise sharply-sympathetic reaction | +2 |
| (18) | Faster inflation month in the Producer's Price Index | +3 |
| (19) | Federal Research Chairman issues bullish sentiments | +1 |
| (20) | Congress votes tax cut | −2 |
| (21) | Short Squeeze | +3 |
| (22) | Popular money letter recommends commodities | 0 |
| (23) | Major new use for product announcement | +2 |
| (24) | Margin requirements cut | −3 |

The Bear cards may represent the following:

| BEAR CARDS | | VALUE |
|---|---|---|
| (1) | Production forecasts raised by government agency | −2 |
| (2) | GNP drops for last quarter | 0 |
| (3) | GNP the same for this quarter as expected but last quarter revised | −2 |

-continued

| BEAR CARDS | | VALUE |
|---|---|---|
| (4) | Popular economist lowers demand forecast | −3 |
| (5) | Chart support level pierced and technicians sell | −2 |
| (6) | Major strike overseas ends and shipments resumed | −1 |
| (7) | Government eliminates price support program | −1 |
| (8) | Exchange orders liquidation of excessive positions | −3 |
| (9) | Retail sales down | 0 |
| (10) | Unemployment up | 0 |
| (11) | Personal income down | +1 |
| (12) | Producer price cut announced | +2 |
| (13) | Banks raise broker' loan rates | −1 |
| (14) | Auto sales down | −1 |
| (15) | Durable goods orders down | 0 |
| (16) | Precious metals drop sharply-sympathetic reaction | −2 |
| (17) | Slower inflation month in Producers' Price Index | +1 |
| (18) | President issues bearish sentiments | +3 |
| (19) | Congress declares inflation #1 problem | −1 |
| (20) | New tax legislation hurts spreaders | −3 |
| (21) | Federal Reserve orders bank cutback on margin loans | −1 |
| (22) | Arbitrage pressures from another exchange | −2 |
| (23) | Corporate profits down | 0 |
| (24) | Consumer credit down | +2 |

The die is used to select a card from one or the other of the sets 13, 14 and includes an indicia of either a "Bull" or "Bear" on each of a selected number of faces.

The game also includes a plurality of transaction tickets 18 which may initially be bound in a pad for removal on an individual basis and distributed to the individual players. Each transaction ticket 18 as shown in FIG. 1 has indicia thereon for recording a round number, one of a "buy" or "sale" transaction, a quantity of the transaction (the number of contracts traded), a price of the transaction, and the names of a purchaser and a seller.

Referring to FIG. 2, the game includes a plurality of trader's tally sheets 19 for determining profits and losses for the various transactions. As indicated in FIG. 1, each sheet 19 may be intergrally formed in a respective section 11 of the board 10. In this case, suitable pencils or pens can be used for writing on the sheets 19 while the surface of the sheet 19 is made washable, for example with a damp cloth. Alternatively, the trader's tally sheets 19 may be provided in a separate pad with the individual sheets being removable for distribution to the respective players.

As indicated in FIG. 2, each trader's tally sheet 19 includes four columns 20–23. One column 20 indicates the round and has spaces for recording the buyer and seller for each transaction in the round. The second column 21 contains spaces for entry of the sale price for a given transaction and the settlement price so as to arrive at a profit or loss for each sales transaction. The third column 22 contains spaces for the entry of the settlement price and the purchase price for a given transaction so as to arrive at a profit or loss for each purchase transaction. The fourth column 23 contains spaces for the entry of the quantity of contracts traded for each transaction and the total trade loss or trade profit for the transaction. A space 24 for a summation of the profit and loss is also provided.

Referring to FIG. 3, the game also includes a broker's tally sheet 25 for summarizing the totals for each player for each round. As indicated, the sheet includes five columns 26–30. One column 26 provides spaces for entry of the designation for the individual players while the remaining four columns 27–30 indicate the summarized profit or loss for each player for each of the rounds of the game. Suitable space is provided at the bottom of each column 27–30 for arriving at a summary of the totals for the profits and losses for each round.

The game may be played in various manners. For example, the game may last four trading rounds with each round consisting of four two and one-half minute sessions. At the start of the first session of each round, each player draws a disk 12. The highest disk becomes the clearing broker for that round. The clearing broker has three duties; namely maintenance of the broker's tally sheet 25 for that round; deciding who has responsibility to re-open a market in the event the market lags; and opening the market.

After establishing the clearing broker, each player returns the selected disk 12 into a central source, for example a bag. The bag is then shaken and each player draws a new disk 12 which is not shown to anyone else. Thereafter, the clearing broker "makes a market". That is, the clearing broker offers to buy or sell at least one contract at prices not more than three points apart, for example 58–61, that is, he will buy at 58 and sell at 61.

After the clearing broker makes his opening market, any other player can "lift his offering" (i.e. buy at 61) or "hit his bid" (sell to him at 58).

In order to make a trade after any player has made a market, so long as the market is valid, (e.g. 58–61), any other player can say "I buy at 61" or "I sell one at 58". If the first player has made a 58–61 market and the second player B wants to buy more than one contract at 61, B can state "I buy three at 61". Player A then has the option of selling a lower number of contracts or fulfilling the offer.

While the initial market is firm, another player can "hit his bid" or "lift his offering" until different bids or offerings are made by subsequent market-makers or a trade occurs. For example, a second player may state "59–61". At this point, the first player's 58 bid is no longer firm but his 61 offering is. The third player C may state "59–60". Now the firm bids are B's and C's at 59. If one bid is hit it will be B's since this was the first 59 bid made. The firm offering is C's at 60. The next player D will have to either hit a 59 bid or lift a 60 offering.

When a trade occurs, a transaction ticket 18 is filled out by the buyer and the seller. The round is numbered on each ticket 18 so that the tickets 18 from various rounds are not confused. The buy or sell is circled depending upon the player in the transaction and the price is indicated. The player's initials or designation is then placed on the ticket 18 and the tickets 18 exchanged.

After the clearing broker makes his opening market, if no trades occur on his opening quote, play proceeds e.g. to the left, with the requirement that each subsequent player must narrow the market (the difference between the bid and the offer) by at least one point or hit the best firm bid or take the best firm offer for at least one contract. For example, the following sequence may take place.

player A "58–61"
player B's choices: 58–60, 59–61, 57–59, 60–62, sell at 58, buy at 61.
player B "58–60"
player C's choices: 58–59, 59–60 buy at 60, sell at 58
player C "58–59"
player D's choices: buy at 59, sell at 58.

If a player (D) initiates a trade, then the player to D's left (E) must restart the market again anywhere he (E) wants, but not more than three points wide. Market-making then proceeds to the left unless another player who is out of turn (X) interjects a market before E gets a chance.

Any player (X) may at any time interject his (X's) market so long as X's bid is higher or offering is lower than the previous market. If X interjects a market then the market narrowing process begins anew from X's left.

Any player (A) may at any time hit any firm bid or lift any firm offering. If (A) does so the market narrowing process begins anew with the player to his left unless another trader (X) interjects his (X's) market before the player to A's left gets a chance. In this event, the market-narrowing process starts with X's market and moves to X's left.

Any player may at any time "size" the most recent market maker's market. The sizing player is asking how many contracts the market maker will buy or sell on his quoted market. The quantity the market maker being sized may be willing to buy may be different from the size he is willing to sell, but the market maker must be willing to do at least one of each of his quoted market.

To size a market, a player C asks most recent market maker B, whose market was 58–60 "What are you good for?". When answering, B always puts his bid before his offer and his buy size before his sell size. B might reply "2 by 4" meaning he will buy up to 2 contracts at 58 and sell up to 4 at 60. Of course, B could answer "one by one", but in no event can his market be wider than his most recent market (it can be narrower), nor can his size be less than one on either side.

If C sizes B's market, unless a third player (X) interjects a better bid or offer, the sizer (C) must buy or sell the lesser of either the size made of two contracts on one of the sides of B's market. In the example above, C would either have had to sell two contracts at 58 or buy two at 60 if no third player had interjected a better bid or offer. Of course, C could have purchased up to four contracts (B's full size) at 60 if he so chose.

If a player (A) says to a firm market-maker (B) "I'll buy (or sell) some there," then A must take as many from B or sell as many to B as B chooses on B's firm market, on whichever side A expressed his interest. B on the other hand must buy or sell at least two contracts to A on his (B's) quoted market.

If trading lags, that is it is unclear who has the responsibility to re-open the market, in order of priority, the re-opener will be:

(1) The player to the left of the last player to initiate a trade, unless (2) a second player made a firm market after the last trade was initiated. Then, the player to the left of the last market-maker must resume the narrowing process.

(3) If it's unclear who made the last market because players were jumping all over with simultaneous bids, offers and trades (known as "free crowd" or "fast market"), then the clearing broker must re-open the market himself.

The Bull and Bear Cards are the element of chance news in the game. Bear cards are predominantly news cards that would usually, but not always, reduce the settlement price whereas Bull cards tend to be news that would increase the settlement price. Before each game five Bull and five Bear cards are dealt out of each set 13, 14 and are put aside without anyone looking at them. The remaining Bull and Bear cards are shuffled after each round.

The sequence of a round of play may be as follows:

First session starts: the time is set e.g. on a timer 31. Everyone has one disk.

The timer runs out. The first session ends. The Bull-/Bear die is thrown. Whichever face shows up on the die, one card of that kind is pulled but is not yet turned over.

Timer is re-set. Second session starts.

Timer runs out, second session ends. Each player draws a second disk which is shown to no one else.

Third session starts. Timer is re-started.

Timer runs out. Third session ends. The Bull/Bear die is thrown. Whichever face shows up on the die, one card of that kind is pulled but is not yet turned over.

Timer is re-set. Fourth session starts.

Timer runs out. End of fourth session. End of trading round. Each player declares what his disks are, and puts them in the middle of the table to be checked. The Bull/Bear cards are turned over. Settlement begins.

After the round ends, all players show their disks. The Bull/Bear cards are turned over. The settlement price is then calculated as the sum of randomly selected disks plus or minus the two Bull/Bear cards for the round.

For example, in a six person game the disks for a round were:

Player A: 3 & 5
B: 4 & 6
C: 2 & 9
D: 0 & 7
E: 8 & 8
F: 1 & 6
First card (Bear) = −2
Second card (Bull) = +1
total: 3 + 5 + 4 + 6 + 2 + 9 + 0 + 7 + 8 + 8 + 1 + 6 − 2 + 1 = 58 settlement price The settlement price is the final value of the contract and is the benchmark against which all trades measured during the round are measured for profit or loss.

Each player can calculate his profit or loss from each round by:

(a) adding all the differences between his transaction prices and the settlement price when he either bought contracts at a lower price or sold contracts at a higher price than settlement, and (b) subtracting the differences between the settlement price and where he either bought contracts at higher price or sold them at a lower price than settlement.

After each player calculates his gain or loss on the session he reports them to the clearing broker who enters the totals on the clearing broker's tally sheet 25. The clearing broker adds up the gains for all the players who made money and then adds up all the losses for all the players who lost money. The total of the gains must always equal the total of the losses in each round. If total gains do equal total losses then the next round may begin.

Other procedures can be used for playing the game in order to simulate other market trading procedures. For example, in a market condition, not all participants are equally knowledgeable. To simulate that condition, the procedures of play may be modified so that some players are assumed to have drawn certain values for their tokens. In addition, the procedures may be modified so that a player may sell or buy more or less contracts so that at the end of each round a player may be "short" or "long".

The invention thus provides a game which is intended to simulate a highly liquid market. The game is not intended to duplicate the precise trading mechanism of any particular market as much as to simulate the feel and experience of a trading environment.

The invention further provides a game in which player interaction is continuous and active. In this respect, the play of the game forces player interaction and encourages simultaneous play by the players. Further, the game is played in a zero sum closed system where there is constant competitive interaction among players.

What is claimed is:

1. A trading game, consisting of a plurality of tokens, each said token having a numbered indicia on one side selected from a given numerical range whereby a randomly selected number of said tokens establishes a first component of a final settlement price;

a first set of "Bull" designated cards, each said card having an indicia of an event on one side and an indicia of a numerical weight for the respective event to establish a second component of the final settlement price;

a second set of "Bear" designated cards, each said card having an indicia of an event on one side and an indicia of a numerical weight for the respective event to establish a third component of the final settlement price;

a die having an indicia of a "Bull" or "Bear" on each of a selected number of faces thereof;

a plurality of transaction tickets, each said ticket having indicia thereon for recording a round number, one of a "buy" or "sale" transaction, a quantity of the transaction, a price of the transaction, a purchaser and a seller;

a plurality of trader's tally sheets, each said sheet having indicia for determining one of a profit and loss for each transaction of a player in a given round; and at least one broker's tally sheet having columnar indicia for itemizing and totaling the profits and losses of all players in a given round.

2. A trading game as set forth in claim 1 wherein each token is a disk.

3. A trading game as set forth in claim 1 wherein said numerical range is from 0 to 9.

4. A trading game as set forth in claim 1 which further comprises a timer for establishing a timed duration of a given round of play.

5. A trading game as set forth in claim 1 wherein each tally sheet has a washable surface.

6. A trading game as set forth in claim 1 wherein each tally sheet is made of plastic.

7. A trading game consisting of a plurality of tokens, each said token having a numbered indicia on one side selected from a given numerical range whereby a randomly selected number of said tokens establishes a first component of a final settlement price;

a first set of "Bull" designated cards, each said card having an indicia of an event on one side and an indicia of a numerical weight for the respective event to establish a second component of the final settlement price;

a second set of "Bear" designated cards, each said card having an indicia of an event on one side and an indicia of a numerical weight for the respective event to establish a third component of the final settlement price;

a die having an indicia of a "Bull" or a "Bear" on each of a selected number of faces thereof;

a plurality of transaction tickets, each said ticket having indicia thereon for recording a round number, one of "buy" or "sell" transaction, a quantity of the transaction, a price of the transaction, a purchaser and a seller;

a board having a plurality of player designated sections, each said section having indicia for determining one of a profit and loss for each transaction of a player in a given round; and a broker's tally sheet having columnar indicia for itemizing and totaling the profits and losses of all players in a given round.

8. A trading game as set forth in claim 7 wherein each tally sheet is made of plastic with a washable surface receiving said respective indicia thereon.

9. A trading game as set forth in claim 8 which further consisting of a timer for establishing a timed duration of a given round of play.

10. A stock trading game consisting of a plurality of tokens, each said token having a numbered indicia on one side selected from 0 to 9 for establishing a first component of a settlement price;

a first set of "Bull" designated cards, each said card having an indicia of an event on one side and an indicia of a numerical weight for the respective event to establish a second component of the settlement price;

a second set of "Bear" designated cards, each said card having an indicia of an event on one side and an indicia of a numerical weight for the respective event to establish a third component of the settlement price;

a die having an indicia of a "Bull" or a "Bear" on each of a selected number of faces thereof;

a plurality of plastic transaction tickets, each said ticket having indicia thereon for recording a round number, one of a "buy" or "sale" transaction, a quantity of the transaction, a price of the transaction, a purchaser and a seller;

a plurality of plastic trader's tally sheets, each said sheet having indicia for determining one of a profit and loss for each transaction of a player in a given round relative to a settlement price obtained from a summation of said first, second and third components of the settlement price; and at least one broker's plastic tally sheet having columnar indicia for itemizing and totaling the profits and losses of all players in a given round.

* * * * *